US005738697A

United States Patent [19]

Wu et al.

[11] Patent Number: 5,738,697

[45] Date of Patent: Apr. 14, 1998

[54] HIGH PERMEABILITY GRINDING WHEELS

[75] Inventors: Mianxue Wu, Worcester; Normand D. Corbin, Northboro; Stephen E. Fox; Thomas Ellingson, both of Worcester; Lee A. Carman, Worcester, all of Mass.

[73] Assignee: Norton Company, Worcester, Mass.

[21] Appl. No.: 687,884

[22] Filed: Jul. 26, 1996

[51] Int. Cl.[6] ..... B24D 3/00

[52] U.S. Cl. ..... 51/296

[58] Field of Search ..... 51/296

[56] References Cited

U.S. PATENT DOCUMENTS

| | | | |
|---|---|---|---|
| 3,273,984 | 9/1966 | Nelson | 51/296 |
| 3,537,121 | 11/1970 | McAvoy | 51/295 |
| 3,547,608 | 12/1970 | Kitazawa | 51/295 |
| 4,401,442 | 8/1983 | Oide | 51/297 |
| 5,009,676 | 4/1991 | Rue et al. | 51/309 |
| 5,035,723 | 7/1991 | Kalinowski et al. | 51/309 |
| 5,037,452 | 8/1991 | Gary et al. | 51/293 |
| 5,129,919 | 7/1992 | Kalinowski et al. | 51/309 |
| 5,185,012 | 2/1993 | Kelly | 51/295 |
| 5,203,886 | 4/1993 | Sheldon et al. | 51/309 |
| 5,221,294 | 6/1993 | Carman et al. | 51/296 |
| 5,244,477 | 9/1993 | Rue et al. | 51/293 |
| 5,429,648 | 7/1995 | Wu | 51/296 |
| 5,431,705 | 7/1995 | Wood | 51/309 |

FOREIGN PATENT DOCUMENTS

| | | | |
|---|---|---|---|
| 1175665 | 10/1984 | Canada | B24D 3/26 |
| 63-209880 | 9/1986 | Japan | B24D 7/06 |
| 3-161273 | 7/1991 | Japan | B24D 3/18 |
| 3-281174 | 12/1991 | Japan | B24D 3/18 |

*Primary Examiner*—Deborah Jones
*Attorney, Agent, or Firm*—Mary E. Porter

[57] ABSTRACT

An abrasive article having certain minimum levels of permeability to fluids comprises about 40 to 80%, by volume interconnected porosity and effective amounts of abrasive grain and bond to carry out soft grinding and deep cut grinding operations. The high permeability to the passage of fluids and interconnected porosity provides an open structure of channels to permit the passage of fluid through the abrasive article and the removal of swarf from the workpiece during grinding operations.

36 Claims, No Drawings

HIGH PERMEABILITY GRINDING WHEELS

BACKGROUND OF THE INVENTION

The invention relates to abrasive articles made by utilizing elongated abrasive grains and other materials having an elongated shape to achieve high permeability characteristics useful in high-performance grinding applications. The abrasive articles have unprecedented permeability, interconnected porosity, openness and grinding performance.

Pores, especially those of which are interconnected in an abrasive tool, play a critical role in two respects. Pores provide access to grinding fluids, such as coolants for transferring the heat generated during grinding to keep the grinding environment constantly cool, and lubricants for reducing the friction between the moving abrasive grains and the workpiece surface and increasing the ratio of cutting to tribological effects. The fluids and lubricants minimize the metallurgical damage (e.g., burn) and maximize the abrasive tool life. This is particularly important in deep cut and modern precision processes (e.g., creep feed grinding) for high efficiency grinding where a large amount of material is removed in one deep grinding pass without sacrificing the accuracy of the workpiece dimension. Therefore, the structural openness (i.e., the pore interconnection) of the wheel, quantified by its permeability to fluids (air, coolants, lubricants, etc.), becomes very critical.

Pores also supply clearance for material (e.g., metal chips or swarf) removed from an object being ground. Debris clearance is essential when the workpiece material being ground is "difficult-to-machine" ductile, or gummy, such as aluminum or some alloys, or where the metal chips are long and the grinding wheel is easy to load up in the absence of pore interconnections.

To make an abrasive tool meeting both of the pore requirements, a number of methods have been tried over the years.

U.S. Pat. No. 5,221,294 of Carman, et al., discloses abrasive wheels having 5–65% void volume achieved by utilizing a one step process in which an organic pore-forming structure is impregnated with an abrasive slurry and then burnt out during heating to yield a reticulated abrasive structure.

JP Pat. No. -A-91-161273 of Gotoh, et al., discloses abrasive articles having large volume pores, each pore having a diameter of 1–10 times the average diameter of the abrasive grain used in the article. The pores are created using materials which burn out during cure.

JP Pat. No. -A-91-281174 of Satoh, et al., discloses abrasive articles having large volume pores, each pore having a diameter of at least 10 times the average diameter of the abrasive grain used in the article. A porosity of 50% by volume is achieved by burn out of organic pore inducing materials during cure.

U.S. Pat. No. 5,037,452 of Gary, et al., discloses an index useful to define the structural strength needed to form very porous wheels.

U.S. Pat. No. 5,203,886 of Sheldon, et al., discloses a combination of organic pore inducers (e.g., walnut shells) and closed cell pore inducers (e.g., bubble alumina) useful in making high porosity vitrified bond abrasive wheels. A "natural or residual porosity" (calculated to be about 28–53%) is described as one part of the total porosity of the abrasive wheel.

U.S. Pat. No. 5,244,477 of Rue, et al., discloses filamentary abrasive particles used in conjunction with pore inducers to produce abrasive articles containing 0–73%, by volume, pores.

U.S. Pat. No. 3,273,984 of Nelson teaches that an abrasive article containing an organic or resinous bond and at least 30%, by volume, abrasive grain, may contain, at most, 68%, by volume, porosity.

U.S. Pat. No. 5,429,648 of Wu discloses vitrified abrasive wheels containing an organic pore inducer which is burned out to form an abrasive article having 35–65%, by volume porosity.

These and other, similar efforts to increase porosity have failed to create sufficient levels of structural permeability in the wheels. For this reason, wheel porosity has not been a reliable predictor of wheel performance.

In addition, where high porosity pore structures have been created by organic pore inducing media (such as walnut shells or napthalene), certain auxiliary problems are created. These media thermally decompose upon firing the green body of the abrasive tool, leaving voids or pores in the cured abrasive tool. Problems of this method include: moisture absorption during storage of the pore inducer; mixing inconsistency and mixing separation, partially due to moisture, and partially due to the density difference between the abrasive grain and pore inducer; molding thickness growth or "springback" due to time-dependent strain release on the pore inducer upon unloading the mold, causing uncontrollable dimension of the abrasive tool; incompleteness of burn-out of pore inducer or "coring" or "blackening" of an fired abrasive article if either the heating rate is not slow enough or the softening point of a vitrified bonding agent is not high enough; exothermic reactions causing difficulties in controlling heating rates, fires and cracked products; and air borne emissions and odors when the pore inducer is thermally decomposed, often causing negative environmental impact.

Introducing closed cell bubbles, such as bubble alumina into an abrasive tool induces porosity without the manufacturing problems of organic burnout methods. However, the pores created by the bubbles are internal and closed, so the pore structure is not permeable to passage of coolant and lubricant.

To overcome these drawbacks, and maximize the permeability of abrasive articles, this invention takes advantage of elongated shape or fiber-like abrasive grains with an aspect ratio of length to diameter, (L/D) of at least 5:1 in abrasive tools and selected fillers, having a filamentary form, alone or in combination with, the filamentary abrasive grain. In the alternative, permeability may be created within the tool during manufacture by heating the green abrasive article to burn or melt temporary elongated materials (e.g., organic fibers or fiberglass) and yield an elongated, interconnected network of open channels within the finished abrasive article.

The elongated materials and shapes in the abrasive article compositions yield high-porosity, high-permeability and high-performance abrasive tools.

SUMMARY OF THE INVENTION

The invention is an abrasive article, comprising about 55% to about 80%, by volume, interconnected porosity, and abrasive grain and bond in amounts effective for grinding, and having an air permeability measured in cc air/second/inch of water of at least 0.44 times the cross-sectional width of the abrasive grain, wherein the interconnected porosity provides an open structure of channels permitting passage of fluid or debris through the abrasive article during grinding.

The invention also includes an abrasive article, comprising about 40% to about 54%, by volume, interconnected porosity, and abrasive grain and bond in amounts effective for grinding, and having an air permeability measured in cc air/second/inch of water of at least 0.22 times the cross-sectional width of the abrasive grain, wherein the interconnected porosity provides an open structure of channels permitting passage of fluid or debris through the abrasive article during grinding.

The abrasive article preferably contains a vitrified bond and fibrous particles of abrasive grain having a L/D ratio of at least 5:1. The abrasive grain may be a sintered seeded sol gel alumina filamentary grain. The abrasive article may be made with or without added pore inducer. Fibrous filler material may be used, alone or in combination with fibrous abrasive grain, to create interconnected porosity in the abrasive article.

DETAILED DESCRIPTION OF THE INVENTION

The abrasive article comprises effective amounts of abrasive grain and bond needed for grinding operations and, optionally, fillers, lubricants or other components. The abrasive articles preferably contain the maximum volume of permeable porosity which can be achieved while retaining sufficient structural strength to withstand grinding forces. Abrasive articles include tools such as grinding wheels, hones and wheel segments as well as other forms of bonded abrasive grains designed to provide abrasion to a workpiece. The abrasive article may comprise about 40 to 80%, preferably 55 to 80% and most preferably 60 to 70%, by volume, interconnected porosity. Interconnected porosity is the porosity of the abrasive article consisting of the interstices between particles of bonded abrasive grain which are open to the flow of a fluid.

The balance of the volume, 20 to 60%, is abrasive grain and bond in a ratio of about 20:1 to 1:1 grain to bond. These amounts are effective for grinding, with higher amounts of bond and grain required for larger abrasive wheels and for formulations containing organic bonds rather than vitrified bonds. Relative to conventional abrasive grain, superabrasive grain in vitrified bond typically requires a higher bond content. In a preferred embodiment, the abrasive articles are formed with a vitrified bond and comprise 15 to 43% abrasive grain and 3 to 15% bond.

In order to exhibit the observed significant improvements in wheel life, grinding performance and workpiece surface quality, the abrasive articles of the invention must have a minimum permeability capacity for permitting the free flow of fluid through the abrasive article. As used herein, the permeability of an abrasive tool is Q/P, where Q means flow rate expressed as cc of air flow, and P means differential pressure. Q/P is the pressure differential measured between the abrasive tool structure and the atmosphere at a given flow rate of a fluid (e.g., air). This relative permeability Q/P is proportional to the product of the pore volume and the square of the pore size. Larger pore sizes are preferred. Pore geometry and abrasive grain size or grit are other factors affecting Q/P, with larger grit size yielding higher relative permeability. Q/P is measured using the apparatus and method described in Example 6, below.

Thus, for an abrasive tool having about 55% to 80% porosity in a vitrified bond, using an abrasive grain grit size of 80 to 120 grit (132–194 micrometers) in cross-sectional width, an air permeability of at least 40 cc/second/inch of water is required to yield the benefits of the invention. For an abrasive grain grit size greater than 80 grit (194 micrometers), a permeability of at least 50 cc/second/inch of water is required.

The relationship between permeability and grit size for 55% to 80% porosity may be expressed by the following equation: minimum permeability=0.44×cross-sectional width of the abrasive grain. A cross-sectional width of at least 220 grit (70 micrometers) is preferred.

For an abrasive tool having from about 40% to less than about 55% porosity in a vitrified bond, using an abrasive grain size of 80 to 120 grit (132–194 micrometers), an air permeability of at least 29 cc/second/inch of water is required to yield the benefits of the invention. For an abrasive grit size greater than 80 grit (194 micrometers), a permeability of at least 42 cc/second/inch of water is required.

The relationship between permeability and grit size for from about 40% to less than 55% porosity may be expressed by the following equation: minimum permeability=0.22× cross-sectional width of the abrasive grain.

Similar relative permeability limits for other grit sizes, bond types and porosity levels may be determined by the practitioner by applying these relationships and D'Arcy's Law to empirical data for a given type of abrasive article.

Smaller cross-sectional width grain requires the use of filament spacers (e.g., bubble alumina) to maintain permeability during molding and firing steps. Larger grit sizes may be used. The only limitation on increasing grit size is that the size be appropriate for the workpiece, grinding machine, wheel composition and geometry, surface finish and other, variable elements which are selected and implemented by the practitioner in accordance with the requirements of a particular grinding operation.

The enhanced permeability and improved grinding performance of the invention results from the creation of a unique, stable, interconnecting porosity defined by a matrix of fibrous particles ("the fibers"). The fibers may consist of abrasive grain or filler or a combination of the two and may have a variety of shapes and geometric forms. The fibers may be mixed with the bond components and other abrasive tool components, then pressed and cured or fired to form the tool. In another preferred embodiment, a mat of fibers, and optionally, other tool components is preformed and, optionally, infused with other mix components, then cured or fired to make the tool in one or more steps.

If the fibers are arranged even more loosely by adding closed cell or organic pore inducer to further separate particles, even higher permeabilities can be achieved. Upon firing, the article comprised of the organic particles will shrink back to result in an article having a smaller dimension because the fibers have to interconnect for integrity of the article. The final dimension after firing of the abrasive tool and the resultant permeability created is a function of aspect ratio of fibers. The higher the L/D is, the higher the permeability of a packed array will remain.

Any abrasive mix formulation may be used to prepare the abrasive articles herein, provided the mix, after forming the article and firing it, yields an article having these minimum permeability and interconnected porosity characteristics.

In a preferred embodiment, the abrasive article comprises a filamentary abrasive grain particle incorporating sintered sol gel alpha alumina based polycrystalline abrasive material, preferably having crystallites that are no larger than 1–2 microns, more preferably less than 0.4 microns in size. Suitable filamentary grain particles are described in U.S. Pat. Nos. 5,244,477 to Rue, et al.; 5,129,919 to Kalinowski, et al.; 5,035,723 to Kalinowski, et al.; and 5,009,676 to Rue, et al., which are hereby incorporated by reference. Other types of polycrystalline alumina abrasive grain having larger crystallites from which filamentary abrasive grain may be obtained and used herein are disclosed in, e.g., U.S. Pat. Nos. 4,314,705 to Leitheiser, et al.; and 5,431,705 to Wood, which are hereby incorporated by reference. Filamentary grain obtained from these sources preferably has a L/D aspect ratio of at least 5:1. Various filamentary shapes may be used, including, e.g., straight, curved, corkscrew and bent fibers. In a preferred embodiment, the alumina fibers are hollow shapes.

In a preferred embodiment the filamentary abrasive grain particles have a grit size greater than 220 grit (i.e., a particle size of greater than 79 μm in diameter). In the alternative, filamentary abrasive grain particles having a grit size of 400 to 220 grit (23 to 79 micrometers) may be used in an agglomerated form having an average agglomerated particle diameter of greater than 79 μm. In a second alternative preferred embodiment, filamentary abrasive grain particles having a grit size of 400 to 220 grit may be used with pore inducer (organic material or closed cell) in an amount effective to space the filaments during firing, and thereby maintain a minimum permeability of at least about 40 cc/second/inch water in the finished wheel.

Any abrasive grain may be used in the articles of the invention, whether or not in filamentary form, provided minimum permeability is maintained. Conventional abrasives, including, but not limited to, aluminum oxide, silicon carbide, zirconia-alumina, garnet and emery may be used in a grit size of about 0.5 to 5,000 micrometers, preferably about 2 to 200 micrometers. Superabrasives, including, but not limited to, diamond, cubic boron nitride and boron suboxide (as described in U.S. Pat. No. 5,135,892, which is hereby incorporated by reference) may be used in the same grit sizes as conventional abrasive grain.

While any bond normally used in abrasive articles may be employed with the fibrous particles to form a bonded abrasive article, a vitrified bond is preferred for structural strength. Other bonds known in the art, such as organic or resinous bonds, together with appropriate curing agents, may be used for, e.g., articles having an interconnected porosity of about 40 to 80%.

The abrasive article can include other additives, including but not limited to fillers, preferably as filamentary or matted or agglomerated filamentary particles, pore inducers, lubricants and processing adjuncts, such as antistatic agents and temporary binding materials for molding and pressing the articles. As used herein, "fillers" excludes pore inducers of the closed cell and organic material types. The appropriate amounts of these optional abrasive mix components can be readily determined by those skilled in the art.

Suitable fillers include secondary abrasives, solid lubricants, metal powder or particles, ceramic powders, such as silicon carbides, and other fillers known in the art.

The abrasive mixture comprising the filamentary material, bond and other components is mixed and formed using conventional techniques and equipment. The abrasive article may be formed by cold, warm or hot pressing or any process known to those skilled in the art. The abrasive article may be fired by conventional firing processes known in the art and selected for the type and quantity of bond and other components. In general, as the porosity content increases, the firing time and temperature decreases.

In addition to the traditional methods of forming abrasive articles, the articles of the invention may be prepared by one step methods, such as is disclosed in U.S. Pat. No. 5,221,294 to Carman, et al., which is hereby incorporated by reference. When using a one step method, a porous structure is initially obtained by selecting a mat or foam structure having interconnected porosity and consisting of an organic (e.g., polyester) or inorganic (e.g., glass) fiber or ceramic fiber matrix, or a ceramic or glass or organic honeycomb matrix or a combination thereof and then infiltrating the matrix with abrasive grain, and bond, followed by firing and finishing, as needed, to form the abrasive article. In a preferred embodiment, layers of polyester fiber mats are arranged in the general shape of an abrasive wheel and infiltrated with an alumina slurry to coat the fibers. This construction is heated to 1510° C. for 1 hour to sinter the alumina and thermally decompose the polyester fiber, and then further processed (e.g., infiltrated with other components) and fired to form the abrasive article. Suitable fiber matrices include a polyester nylon fiber mat product obtained from Norton Company, Worcester, Mass.

In another preferred embodiment, woven mats of resin coated fiberglass are layered into an abrasive wheel mold along with an abrasive mix containing abrasive grain, vitrified bond components and optional components. This structured mix is processed with conventional methods to form an abrasive article having regularly spaced pores in the shape of large channels transversing the wheel.

Abrasive articles prepared by any of these methods exhibit improved grinding performance. In wet grinding operations such abrasive tools have a longer wheel life, higher G-ratio (ratio of metal removal rate to wheel wear rate) and lower power draw than similar tools prepared from the same abrasive mix but having lower interconnected porosity and permeability and/or having the same porosity, but less interconnected porosity and lower permeability. The abrasive tools of the invention also yield a better, smoother workpiece surface than conventional tools.

Example 1

This example demonstrates the manufacture of grinding wheels using long aspect ratio, seeded sol-gel alumina (TARGA™) grains obtained from Norton Company (Worcester, Mass.) with an average L/D ~7.5, without added pore inducer. The following Table 1 lists the mixing formulations:

TABLE 1

Composition of Raw Material Ingredients for Wheels 1–3

| Ingredient | Parts by weight (1) | (2) | (3) |
|---|---|---|---|
| Abrasive grain* | 100 | 100 | 100 |
| Pore inducer | 0 | 0 | 0 |
| Dextrin | 3.0 | 3.0 | 3.0 |
| Aromer Glue (animal based) | 4.3 | 2.8 | 1.8 |
| Ethylene glycol | 0.3 | 0.2 | 0.2 |
| Vitrified bonding agent | 30.1 | 17.1 | 8.4 |

*(120 grit, ~132 × 132 × 990 μm)

For each grinding wheel, the mix was prepared according to the above formulations and sequences in a Hobart® mixer. Each ingredient was added sequentially and was mixed with the previous added ingredients for about 1–2 minutes after each addition. After mixing, the mixed material was placed into a 7.6 cm (3 inch) or 12.7 cm (5 inch) diameter steel mold and was cold pressed in a hydraulic molding press for 10–20 seconds resulting in 1.59 cm (⅝ inch) thick disk-like wheels with a hole of 2.22 cm (⅞ inch). The total volume (diameter, hole and thickness) as-molded wheel and total weight of ingredients were predetermined by the desired and calculated final density and porosity of such a grinding wheel upon firing. After the pressure was removed from the pressed wheels, the wheel was taken away manually from the mold onto a batt for drying 3–4 hours before firing in a kiln, at a heating rate of 50° C./hour from 25° C. to the maximum 900° C., where the wheel was held for 8 hours before it was naturally cooled down to room temperature in the kiln.

The density of the wheel after firing was examined for any deviation from the calculated density. Porosity was determined from the density measurements, as the ratio of the densities of abrasive grain and vitrified bonding agent had been known before batching. The porosities of three abrasive articles were 51%, 58%, and 62%, by volume, respectively.

Example 2

This example illustrates the manufacture of two wheels using TARGA™ grains with an L/D ~30, without any pore inducer, for extremely high porosity grinding wheels.

The following Table 2 list the mixing formulations. After molding and firing, as in Example 1, vitrified grinding wheels with porosities (4) 77% and (5) 80%, by volume, were obtained.

TABLE 2

Composition of raw material ingredients for wheels 4–5

| Ingredient | Parts by Weight (4) | (5) |
|---|---|---|
| Abrasive grain* | 100 | 100 |
| Pore inducer | 0 | 0 |
| Dextrin | 2.7 | 2.7 |
| Aromer (animal) Glue | 3.9 | 3.4 |
| Ethylene glycol | 0.3 | 0.2 |
| Vitrified bonding agent | 38.7 | 24.2 |

*(120 grit, ~135 × 80 × 3600 μm)

Example 3

This example demonstrates that this process can produce commercial scale abrasive tools, i.e., 500 mm (20 inch) in diameter. Three large wheels (20×1×8 inch, or 500×25×200 mm) were made using long TARGA™ grains having an average L/D ~6.14, 5.85, 7.6, respectively, without added pore inducer, for commercial scale creep-feed grinding wheels.

The following Table 3 lists the mixing formulations. At molding stage, the maximum springback was less than 0.2% (or 0.002 inch or 50 μm, compared to the grain thickness of 194 μm) of the wheel thickness, far below grinding wheels of the same specifications containing pore inducer. The molding thickness was very uniform from location to location, not exceeding 0.4% (or 0.004 inch or 100 μm) for the maximum variation. After molding, each grinding wheel was lifted by air-ring from the wheel edge onto a batt for overnight drying in a humidity-controlled room. Each wheel was fired in a kiln with a heating rate of slight slower than 50° C./hour and holding temperature of 900° C. for 8 hours, followed by programmed cooling down to room temperature in the kiln.

After firing, these three vitrified grinding wheels were determined to have porosities: (6) 54%, (7) 54% and (8) 58%, by volume. No cracking was found in these wheels and the shrinkage from molded volume to fired volume was equal to or less than observed in commercial grinding wheels made with bubble alumina to provide porosity to the structure. The maximum imbalances in these three grinding wheels were 13.6 g (0.48 oz), 7.38 g (0.26 oz), and 11.08 g (0.39 oz), respectively, i.e., only 0.1%–0.2% of the total wheel weight. The imbalance data were far below the upper limit at which a balancing adjustment is needed. These results suggest significant advantages of the present method in high-porosity wheel quality consistency in manufacturing relative to conventional wheels.

TABLE 3

Composition of Raw Material Ingredients For Wheels 6–8

| Ingredient | Parts by Weight (6) | (7) | (8) |
|---|---|---|---|
| Abrasive grain* | 100 | 100 | 100 |
| Pore inducer | 0 | 0 | 0 |
| Dextrin | 4.0 | 4.5 | 4.5 |
| Aromer (animal) Glue | 2.3 | 3.4 | 2.4 |
| Ethylene glycol | 0.2 | 0.2 | 0.2 |
| Vitrified bonding agent | 11.5 | 20.4 | 12.7 |

*(80 grit, ~194 × 194 × [194 × 6.14] μm)

Example 4

(I) Abrasive wheels comprising an equivalent volume percentage open porosity were manufactured on commercial scale equipment from the following mixes to compare the productivity of automatic pressing and molding equipment using mixes containing pore inducer to that of the invention mixes without pore inducer.

Wheel 9 Mix Formulations

| Ingredient | Percent by Weight (A) Invention | (B) Conventional |
|---|---|---|
| Abrasive grain* | 100 | 100 |
| Pore inducer (walnut shell) | 0 | 8.0 |
| Dextrin | 3.0 | 3.0 |
| Glue | 0.77 | 5.97 |
| Ethylene glycol | 0 | 0.2 |
| Water | 1.46 | 0 |
| Drying agent | 0.53 | 0 |
| Vitrified bonding agent | 17.91 | 18.45 |

*(A) 120 grit, 132 × 132 × 990 μm.
(B) 50% sol gel alumina 80 grit/50% 38A aluinina 80 grit, abrasive grain obtained from Norton Company, Worcester, MA.

A productivity (rate of wheel production in the molding process per unit of time) increase of 5 times was observed for the mix of the invention relative to a conventional mix containing pore inducer. The invention mix exhibited free flow characteristics permitting automatic pressing operations. In the absence of pore inducer, the mix of the invention exhibited no springback after pressing and no coring during firing. The permeability of the wheels of the invention was 43 cc/second/inch water.

(II) Abrasive wheels comprising an equivalent volume percentage of open porosity were manufactured from the following mixes to compare the firing characteristics of mixes containing pore inducer to that of the invention mixes.

Wheel 10 Mix Formulations

| Inqredient | Percent by Weigtt (A) Invention | (B) Conventional |
|---|---|---|
| Abrasive grain* | 100 | 100 |
| Pore inducer (walnut shell) | 0 | 8.0 |
| Dextrin | 2.0 | 2.0 |
| Glue | 1.83 | 2.7 |
| Animal Glue | 4.1 | 5.75 |
| Ethylene glycol | 0 | 0.1 |
| Bulk agent (Vinsol powder) | 0 | 1.5 |
| Vitrified bonding agent | 26.27 | 26.27 |

*(A) 80 grit, 194 × 194 × 1360 μm.
(B) 50% sol gel alumina 36 grit/50% 38A alumina 36 grit, abrasive grain obtained from Norton Company, Worcester, MA.

The wheels of the invention showed no signs of slumpage, cracking or coring following firing. Prior to firing, the green, pressed wheels of the invention had a high permeability of 22 cc/second/inch water, compared to the green, pressed wheels made from a conventional mix containing pore inducer which was 5 cc/second/inch water. The high green permeability is believed to yield a high mass/heat transfer rate during firing, resulting in a higher heat rate capability for the wheels of the invention relative to conventional wheels. Firing of the wheels of the invention was completed in one-half of the time required for conventional wheels utilizing equivalent heat cycles. The permeability of the fired wheels of the invention was 45 cc/second/inch water.

Example 5

This example demonstrates that high-porosity grinding wheels may be made by using pre-agglomerated grains. The pre-agglomerated grain was made during extrusion of elongated sol gel alpha-alumina grain particles by a controlled reduction in the extrusion rate. The reduction in rate caused agglomerates to form as the material exited the extruder die prior to drying the extruded grain.

High-porosity wheels were made as described in Example 1 from agglomerated and elongated TARGA™ grain without using any pore inducer (an average agglomerate had ~5–7 elongated grains, and the average dimension of each was ~194×194×(194×5.96) μm. The nominal aspect ratio was 5.96, and the LPD was 0.99 g/cc. The following Table 5 lists the mixing formulations. After molding and firing, vitrified grinding wheels were made with a porosity of 54%, by volume.

Wheel 11 Mix Formulation

| | Parts by Weight |
|---|---|
| Abrasive grain* | 100 |
| Pore inducer | 0 |
| Dextrin | 2.7 |
| Aroma Glue | 3.2 |
| Ethylene glycol | 2.2 |
| Vitrified bonding aqent | 20.5 |

*(agglomerates of 80 grit, ~194 × 194 × 1160 μm)

Example 6

This example describes the permeability measurement test and demonstrates that the permeability of abrasive articles can be increased greatly by using abrasive grains in the form of fibrous particles.

Permeability Test

A quantitative measurement of the openness of porous media by permeability testing, based on D'Arcy's Law governing the relationship between the flow rate and pressure on porous media, was used to evaluate wheels. A non-destructive testing apparatus was constructed. The apparatus consisted of an air supply, a flowmeter (to measure Q, the inlet air flow rate), a pressure gauge (to measure change in pressure at various wheel locations) and a nozzle connected to the air supply for directing the air flow against various surface locations on the wheel.

An air inlet pressure Po of 1.76 kg/cm$^2$ (25 psi), inlet air flow rate Qo of 14 m$^3$/hour (500 ft3/hour) and a probing nozzle size of 2.2 cm were used in the test. Data points (8–16 per grinding wheel) (i.e., 4–8 per side) were taken to yield an accurate average.

Wheel Measurements

Table 4 shows the comparison of permeability values (Q/P, in cc/sec/inch of water) of various grinding wheels.

TABLE 4

Wheel Permeability

| Abrasive Wheel Sample | Porosity (Vol. %) | Permeability* Q/P cc/sec/inch $H_2O$ Invention | Control |
|---|---|---|---|
| Example 1 | | | |
| (1) | 51 | 45 | 23 |
| (2) | 58 | 75 | 28 |
| (3) | 62 | 98 | 31 |
| Example 2 | | | |
| (4) | 77 | 225 | n/a |
| (5) | 80 | 280 | n/a |
| Example 3 | | | |
| (6) | 54 | 71 | 30 |
| (7) | 54 | 74 | 30 |
| (8) | 58 | 106 | 34 |
| Example 4 | | | |
| (9) | 50 | 45 | 22 |
| (10) | 47 | 47 | 28 |
| Example 5 (11) | 54 | 43 | 25 |

Data was standardized by using wheels of at least one-half inch (1.27 cm) in thickness, typically one inch (2.54 cm) thick. It was not possible to make wheels to serve as controls for Example 2 because the mix could not be molded into the high porosity content of the wheels of the invention (achieved using elongated abrasive grain in an otherwise standard abrasive mix). The control wheels were made using a 50/50 volume percent mixture of a 4:1 aspect ratio sol gel alumina abrasive grain with a 1:1 aspect ratio sol gel or 38A alumina abrasive grain, all obtained from Norton Company, Worcester, Mass.

Wheel 11 comprised agglomerated elongated abrasive grain, therefore, the data does not lend itself to a direct comparison with non-agglomerated elongated grain particles nor to the permeability description provided by the equation: permeability=0.44×cross-sectional width of the abrasive grain. However, the permeability of the wheel of the invention compared very favorably to the control and was approximately equal to the predicted permeability for a wheel containing an otherwise equivalent type of non-agglomerated elongated grain.

The data show that the wheels made by the process of the invention have about 2–3 times higher permeability than conventional grinding wheels having the same porosity.

Example 7

This example demonstrates how the L/D aspect ratio of abrasive grain changes the grinding performance in a creep feed grinding mode. A set of grinding wheels having 54% porosity and equal amounts of abrasive and bonding agent, made in a Norton Company manufacturing plant to a diameter of 50.8×2.54×20.32 cm (20×1×8 inch), were selected for testing, as shown in Table 5, below.

TABLE 5

Properties differences among wheels

| Grain[a] | Control Grain Mixture | Control Grain | Elongated Grain 1 | Elongated Grain 2 |
|---|---|---|---|---|
| (L/D) | 50% 4.2:1 50% 1:1 (vol) | 4.2:1 | 5.8:1 | 7.6:1 |
| Inducer Type | bubble alumina + walnut shell | Piccotac ® resin | none | none |
| Air permeability (cc/sec/inch $H_2O$) | 19.5 | 37.6 | 50.3 | 55.1 |

[a]All grain was 120 grit seeded sol gel alumina grain obtained from Norton Company, Worcester, MA.

These wheels were tested for grinding performance. The grinding was carried out on blocks of 20.32×10.66×5.33 cm (8×4×2 inch) of 4340 steel (Rc 48–52) by a down-cut, non-continuous dress creep feed operation on a Blohm machine along the longest dimension of the blocks. The wheel speed was 30.5 meters/sec (6000 S.F.P.M.), the depth of cut was 0.318 cm (0.125 inch) and the table speed was from 19.05 cm/min (7.5 in/min) at an increment of 6.35 cm/min (2.5 inch/min) until workpiece burn.

The grinding performance was greatly improved by using elongated Targa grains to make abrasive wheels having 54% porosity and an air permeability of at least about 50 cc/second/inch water. Table 6 summarizes the results of various grinding aspects. In addition to the benefits of interconnected porosity, the grinding productivity (characterized by metal removal rate) and grindability index (G-ratio divided by specific energy) are both a function of the aspect ratio of abrasive grain: the performance increases with increasing L/D.

TABLE 6

Grinding differences among 4 wheels

| Grinding Parameter | Control Grain Mixture | Control Grain | Elongated Grain 1 | Elongated Grain 2 |
|---|---|---|---|---|
| Maximum table speed without burn | 17.5 | 22.5 | 25 | 32.5 |
| G-ratio @ 15 in/min speed | 25.2 | 23.4 | 32.7 | 37.2 |
| G-ratio @ 25 in/min speed | burn | burn | 24.2 | 31.6 |
| Power @ 15 in/min speed (HP/in) | 22 | 20.8 | 18.8 | 15.7 |
| Power @ 25 in/min speed (HP/in) | burn | burn | 30.6 | 24.4 |
| Force $F_v$ @ 15 in/min speed (lbf/in) | 250 | 233 | 209 | 176 |
| Force $F_v$ @ 25 in/min speed (lbf/in) | burn | burn | 338 | 258 |
| Grindability Index @ 15 in/min speed | 2.12 | 2.08 | 3.23 | 4.42 |
| Grindability Index @ 25 in/min speed | burn | burn | 2.43 | 4.00 |

Speed in cm/minute is equal to 2.54×speed in in/min. Force in Kg/cm is equal to 5.59×force in lbf/in.

Similar grinding performance results were obtained for wheels containing 80 to 120 grit abrasive grain. For the smaller grit sizes, significant grinding improvements were observed for wheels having a permeability of at least about 40 cc/second/inch water.

Example 8

This example illustrates the preparation of permeable abrasive articles utilizing fibrous thermally decomposable materials in a mat structure to generate high interconnected porosity in the cured abrasive article.

Using the formulation shown below, the components were mixed as described in Example 1 and the mix was layered into a mold (5.0×0.53×0.875 inch) and pressed to form green wheels. Wheels 12 and 13 contained 5 layers of equally spaced abrasive mix separated by 4 layers of resin coated fiber glass mat (30% resin on 70%, by weight, E glass, obtained from Industrial Polymer and Chemicals as product #3321 and #57). A fine mesh mat with 1 mm square openings (#3321) was used for wheel 12 and a coarse mesh mat with 5 mm square openings (#57) was used for wheel 13. Wheel 14, the control, contained no fiber glass mesh.

Composition of Raw Material Ingredients For Wheels 12–14

| Ingredient | Parts by Weight (12) | (13) | (14) |
|---|---|---|---|
| Abrasive grain* | 100 | 100 | 100 |
| Fiber mat | 4 layers | 4 layers | none |
| Dextrin | 0.8 | 0.8 | 0.8 |
| Glue (AR30) | 1.94 | 1.94 | 1.94 |
| Vitrified bonding agent | 13.56 | 13.56 | 13.56 |

*(80 grit, sol gel alpha-alumina grain)

The green wheels were removed from the press, dried and fired as in Example 1. After firing, the outer diameter of the wheels were ground to expose the pore channels formed by decomposition of the fiber glass mat. The wheels were unitary structures suitable for grinding operations. X-ray radiographic images were taken and confirmed the existence of an internal network of large fluid-permeable channels approximating the size and location of the fiber glass mesh in wheels 12 and 13 and no channels in wheel 14. Thus, wheels 12 and 13 were suitable for use in the invention.

Example 9

This example illustrates the preparation of permeable abrasive articles utilizing laminates of a non-woven matt of an organic substrate which has been coated with an alumina slip. The laminate was heat-treated to sinter the alumina and then used as a matrix for forming a permeable abrasive article.

The alumina slip components were mixed in a high intensity mixer (Premier Mill Corporation Laboratory Disperator model) by mixing at 500 rpms 100 g boehmite sol (Condea, Desperal sol 10/2 liquid obtained from Condea Chemie, GmbH), 0.15 mls Nalco defoamer and 300 g alpha-alumina powder (Ceralox-APA-0.5 μm, with MgO, obtained from Ceralox Corporation), increasing the mixing speed to 2500–3000 rpms as the viscosity increased. The mixture was milled with 99.97% purity alumina oxide 0.5 inch cylindrical milling media in a 1000 ml Nalgene container mounted on a Red Devil paint shaker for 15 minutes, then screened on a 10 U.S. mesh Tyler screen to yield the alumina slip.

The alumina slurry was used to coat six (3.75×0.25 inch) polyester/nylon non-woven fibrous matting discs (obtained from Norton Company). The coated discs were stacked onto an alumina batt covered with a paper disc, another paper disc and alumina batt was placed onto the stack and two 1 inch high blocks were placed at either side of the stack. Pressure was applied to the top batt to compress the stack to the same height as the blocks. The stacked discs were dried at room temperature for 4 hours and in an 80° C. oven for 4 hours. The coated discs were fired using a temperature ramp cycle to a maximum temperature of 1510° C. to form an alumina matrix.

Following firing, the alumina matrix was infiltrated with a dispersion of vitrified bond materials. The dispersion was prepared in the same high intensity mixer used for the alumina slip by setting the mixer to 500–700 rpms and mixing 70 g of deionized water at 50° C., 0.3 mls of Darvan 821A dispersing agent (obtained from R. T. Vanderbilt Co., Inc), 0.15 mls of Nalco defoamer, 30 g of a frit bond powder (a raw bond mixture was melted into a glass, cooled, ground and screened to yield a frit having a mean particle size of 10–20 μm), and 1 g Gelloid C 101 polymer (FMC Corporation). The dispersion temperature was adjusted to 40°–45° C. with constant stirring to minimize viscosity for infiltration of the alumina matrix.

The alumina matrix (containing 115 g of alumina) was placed in a petri dish and submerged with the bond dispersion, placed in a vacuum chamber and a vacuum was drawn to insure complete infiltration of the glass frit bond dispersion into the matrix. Upon cooling, the bond dispersion formed a gel and excess gel was scraped from the outside of the alumina matrix. The infiltrated alumina matrix (containing 42.8 g bond) was fired in a temperature ramp firing cycle at a maximum temperature of 900° C. to yield an abrasive article having the bond composition described in Example 1 of U.S. Pat. No. 5,035,723, which is hereby incorporated by reference. The abrasive article was a highly permeable, unitary structure, having 70–80%, by volume porosity, with suitable strength for grinding operations.

Example 10

This example illustrates the preparation of a permeable abrasive article utilizing a fibrous material comprising the abrasive grain and the bond in proportions suitable for the cured abrasive article. The fibrous material was made from a slurry mixture of 5.75 to 1.0 volumetric ratio of sol gel alpha-alumina grain to vitrified bond components by injection molding and sintering. The wheel (3 inch diameter) was made as described in Example 1, but using the mix formulation shown below.

Wheel 15 Mix Formulation

| | Parts by Weight |
|---|---|
| Fibrous grain material | 100 |
| Pore inducer | 0 |
| Dextrin | 3.17 |
| Aroma Glue | 8.32 |
| Ethylene glycol | 0.17 |
| Vitrified bonding agent | 8.28 |

The wheels had 80%, by volume, porosity, an air permeability of 350 cc/second/inch water, and were unitary structures suitable for soft grinding operations.

We claim:

1. An abrasive article, comprising about 55% to about 80%, by volume, interconnected porosity defined by a matrix of fibrous particles, the fibrous particles having a length to diameter aspect ratio of at least 5:1, and abrasive grain and bond in amounts effective for grinding, and having an air permeability measured in cc air/second/inch of water of at least 0.44 times the cross-sectional width of the abrasive grain, wherein the interconnected porosity provides an open structure of channels permitting passage of fluid or debris through the abrasive article during grinding, and wherein the fibrous particles consist of materials selected from the group consisting of abrasive grain, filler, combinations thereof, and agglomerates thereof.

2. The abrasive article of claim 1 comprising 60 to 70%, by volume, interconnected porosity.

3. The abrasive article of claim 1, wherein the bond is a vitrified bond.

4. The abrasive article of claim 3, wherein the abrasive article comprises 3 to 15%, by volume, vitrified bond.

5. The abrasive article of claim 1, comprising 15 to 43%, by volume, abrasive grain.

6. The abrasive article of claim 1, wherein the abrasive article is substantially free of porosity inducer.

7. The abrasive article of claim 1, wherein the fibrous particles are sintered sol gel alpha alumina abrasive grain having a length to diameter aspect ratio of at least 5:1.

8. The abrasive article of claim 1, wherein the filler is selected from the group consisting of ceramic fiber, glass fiber, organic fiber, combinations thereof, and agglomerates thereof.

9. The abrasive article of claim 7, wherein the article has a permeability of at least 50 cc/second/inch of water for abrasive grain larger than 80 grit.

10. The abrasive article of claim 1, wherein the fibrous particles have a length to diameter aspect ratio of at least 6:1.

11. The abrasive article of claim 7, wherein the abrasive article comprises about 16 to 34%, by weight, abrasive grain.

12. An abrasive article, having an air permeability measured in cc air/second/inch of water of at least 0.44 times the cross-sectional width of the abrasive grain, and comprising:

(a) prior to curing the abrasive article, a matrix of fibrous particles, the fibrous particles having a length to diameter aspect ratio of at least 5:1;

(b) after curing the abrasive article, about 55% to about 80%, by volume, interconnected porosity, the interconnected porosity being defined by the matrix of fibrous particles; and (c) abrasive grain and bond in amounts effective for grinding;

wherein the interconnected porosity provides an open structure of channels permitting passage of fluid or debris through the abrasive article during grinding; and wherein the matrix of fibrous particles is at least one layer of structured filler selected from the group consisting of glass mat, organic mat, ceramic fiber mat, and combinations thereof.

13. The abrasive article of claim 12, wherein the ceramic fiber mat is coated with a vitrified bond material.

14. The abrasive article of claim 12, wherein the organic fiber mat is a polyester fiber mat having a coating of an alumina slurry.

15. The abrasive article of claim 14, wherein the alumina slurry is sintered by heating the coated mat to 1500° C. prior to forming the abrasive article.

16. The abrasive article of claim 1, wherein the abrasive article comprises about 15 to 55%, by volume, abrasive grain and about 5 to 20%, by volume, bond.

17. The abrasive article of claim 1, wherein the fibrous particles comprise a combination of abrasive grain and bond in amounts effective for grinding.

18. The abrasive article of claim 17, wherein the fibrous particle comprises about 16 to 34%, by volume, abrasive grain and about 3 to 15%, by volume, bond.

19. An abrasive article, comprising about 40% to about 54%, by volume, interconnected porosity defined by a matrix of fibrous particles, the fibrous particles having a length to diameter aspect ratio of at least 5:1, and abrasive grain and bond in amounts effective for grinding, and having an air permeability measured in cc air/second/inch of water of at least 0.22 times the cross-sectional width of the abrasive grain, wherein the interconnected porosity provides an open structure of channels permitting passage of fluid or debris through the abrasive article during grinding, and wherein the fibrous particles consist of materials selected from the group consisting of abrasive grain, filler, combinations thereof, and agglomerates thereof.

20. The abrasive article of claim 19 comprising 50 to 54%, by volume, interconnected porosity.

21. The abrasive article of claim 19, wherein the bond is a vitrified bond.

22. The abrasive article of claim 21, wherein the abrasive article comprises 3 to 15% by volume, vitrified bond.

23. The abrasive article of claim 19, comprising 31 to 57%, by volume, abrasive grain.

24. The abrasive article of claim 19, wherein the abrasive article is substantially free of porosity inducer.

25. The abrasive article of claim 19, wherein the fibrous particles are sintered sol gel alpha alumina abrasive grain having a length to diameter aspect ratio of at least 5:1.

26. The abrasive article of claim 19, wherein the filler is selected from the group consisting of ceramic fiber, glass fiber, organic fiber, combinations thereof, and agglomerates thereof.

27. The abrasive article of claim 25, wherein the article has a permeability of at least 50 cc/second/inch of water for abrasive grain larger than 80 grit.

28. The abrasive article of claim 19, wherein the fibrous particles have a length to diameter aspect ratio of at least 6:1.

29. The abrasive article of claim 25, wherein the abrasive article comprises about 31 to 57%, by volume, abrasive grain.

30. An abrasive article, having an air permeability measured in cc air/second/inch of water of at least 0.44 times the cross-sectional width of the abrasive grain, and comprising:

(a) prior to curing the abrasive article, a matrix of fibrous particles, the fibrous particles having a length to diameter aspect ratio of at least 5:1;

(b) after curing the abrasive article, about 55% to about 80%, by volume, interconnected porosity, the interconnected porosity being defined by the matrix of fibrous particles; and (c) abrasive grain and bond in amounts effective for grinding;

wherein the interconnected porosity provides an open structure of channels permitting passage of fluid or debris through the abrasive article during grinding; and wherein the matrix of fibrous particles is at least one layer of structured filler selected from the group consisting of glass mat, organic mat, ceramic fiber mat, and combinations thereof.

31. The abrasive article of claim 30, wherein the organic fiber mat is coated with a vitrified bond material.

32. The abrasive article of claim 30, wherein the organic fiber mat is a polyester fiber mat having a coating of an alumina slurry.

33. The abrasive article of claim 32, wherein the alumina slurry is sintered by heating the coated mat to about 1500° C. prior to forming the abrasive article.

34. The abrasive article of claim 19, wherein the abrasive article comprises about 15 to 55%, by volume, abrasive grain and about 5 to 20%, by volume, bond.

35. The abrasive article of claim 19, wherein the fibrous particles comprise a combination of abrasive grain and bond in amounts effective for grinding.

36. The abrasive article of claim 35, wherein the fibrous particle comprises about 16 to 34%, by volume, abrasive grain and about 3 to 15%, by volume, bond.

* * * * *